US005245796A

United States Patent [19]

Miller et al.

[11] Patent Number: 5,245,796

[45] Date of Patent: Sep. 21, 1993

[54] SLURRY POLISHER USING ULTRASONIC AGITATION

[75] Inventors: Gabriel L. Miller, Westfield; Eric R. Wagner, South Plainfield, both of N.J.

[73] Assignee: AT&T Bell Laboratories, Murray Hill, N.J.

[21] Appl. No.: 862,044

[22] Filed: Apr. 2, 1992

[51] Int. Cl.[5] ..... B24B 53/007

[52] U.S. Cl. ..... 51/283 R; 51/317; 51/262 A; 51/325

[58] Field of Search ..... 51/59 SS, 131.1, 317, 51/325, 131.3, 131.5, 283 R, 132, 262 A

[56] References Cited

U.S. PATENT DOCUMENTS

| | | | |
|---|---|---|---|
| 3,093,937 | 6/1963 | Balamuth et al. | 51/59 SS |
| 3,123,951 | 3/1964 | Kuris et al. | 51/262 A |
| 3,855,441 | 12/1974 | Kimmelmann | 219/68 |
| 4,004,375 | 1/1977 | Wieck | 51/59 SS |
| 4,069,805 | 1/1978 | Sherman | 125/30 |
| 4,927,432 | 5/1990 | Budinger et al. | 51/298 |
| 5,055,158 | 10/1991 | Gallagher et al. | 156/643 |
| 5,104,828 | 4/1992 | Morimoto et al. | 51/132 |
| 5,154,021 | 10/1992 | Bombardier et al. | 51/262 A |

FOREIGN PATENT DOCUMENTS

| | | | |
|---|---|---|---|
| 3625286 | 2/1988 | Fed. Rep. of Germany | 51/262 A |
| 0185556 | 8/1988 | Japan | 51/7 |

*Primary Examiner*—Robert A. Rose

*Attorney, Agent, or Firm*—Geoffrey D. Green

[57] ABSTRACT

Slurry in a slurry polisher is ultrasonically agitated during polishing to dislodge embedded debris and grit from the polishing pad and thereby improve the uniformity of material removal, lengthen the life of the pad and avoid scratches and defects on the surface being polished. The method is particularly useful for applications in which slurry polishing is used for planarizing deposited layers on semiconductor wafers where non-uniformities caused by such embedded material can affect process yields. Apparatus is disclosed for applying ultrasonic energy to the slurry so that such energy is focussed on the pad.

6 Claims, 1 Drawing Sheet

SLURRY POLISHER USING ULTRASONIC AGITATION

FIELD OF THE INVENTION

This invention relates to methods of and apparatus for slurry polishing of workpieces and, more particularly, to methods of and apparatus for planarizing deposited layers on semiconductor wafers by slurry polishing.

BACKGROUND OF THE INVENTION

Slurry polishers are well known in the art and are also well known for use in planarizing deposited layers on semiconductor wafers. For example, U.S. Pat. No. 5,055,158 discloses a use of slurry polishing in the manufacture of Josephson integrated circuits where a deposited dielectric material is planarized so that additional layers can be deposited.

Typically, a slurry polisher comprises a rotating horizontal pad covered by a layer of polishing slurry. The workpiece, typically a semiconductor wafer, is pressed against the rotating pad and polishing results. The wafer itself is usually rotated at a slower rate than the pad and may also be moved radially back and forth across the rotating pad to equalize material removal from the wafer surface.

The material of the polishing pad is chosen for its ability to act as a carrier of the slurry and to wipe away the grit and debris resulting from the polishing action. One particular pad material is described in U.S. Pat. No. 4,927,432.

A typical application of slurry polishing on semiconductor wafers is to planarize a deposited layer on a wafer. For example, after a number of processing steps, such as masking, doping, etching and the like, have been performed on the wafer, the surface of the wafer can become uneven. It may be necessary to smooth out the surface for subsequent processing steps. For this purpose, a layer of insulating or dielectric material, e.g. silicon dioxide, can be deposited on the uneven surface and then polished to obtain the desired smooth surface. It is clear that such polishing operations must be carried out in such a way that scratches or other defects do not appear on the polished surface and that the material removal should preferably be extremely uniform across the surface. Unfortunately, after a period of use, a slurry polishing pad deteriorates and must be replaced. Polishing with a deteriorated or worn pad causes more scratches and other defects as well as surface non-uniformities.

One drawback to the use of slurry polishing is that the polishing pads may have to be replaced more than once in a factory shift, which causes production bottlenecks when the polishing machine has to be taken out of use for such replacement. It is therefore desirable to find a way to prolong the life of such polishing pads to at least a full shift.

SUMMARY OF THE INVENTION

The slurry in a slurry polisher is ultrasonically agitated during polishing to dislodge embedded debris and grit from the polishing pad and thereby lengthen the life of the pad and avoid scratches, defects and non-uniform removal on the surface being polished. The method is particularly useful for applications in which slurry polishing is used for planarizing semiconductor wafers since surface non-uniformities can affect process yields. Apparatus is disclosed for applying ultrasonic energy to the slurry so that such energy is focussed on the pad.

DETAILED DESCRIPTION

Figure 1:
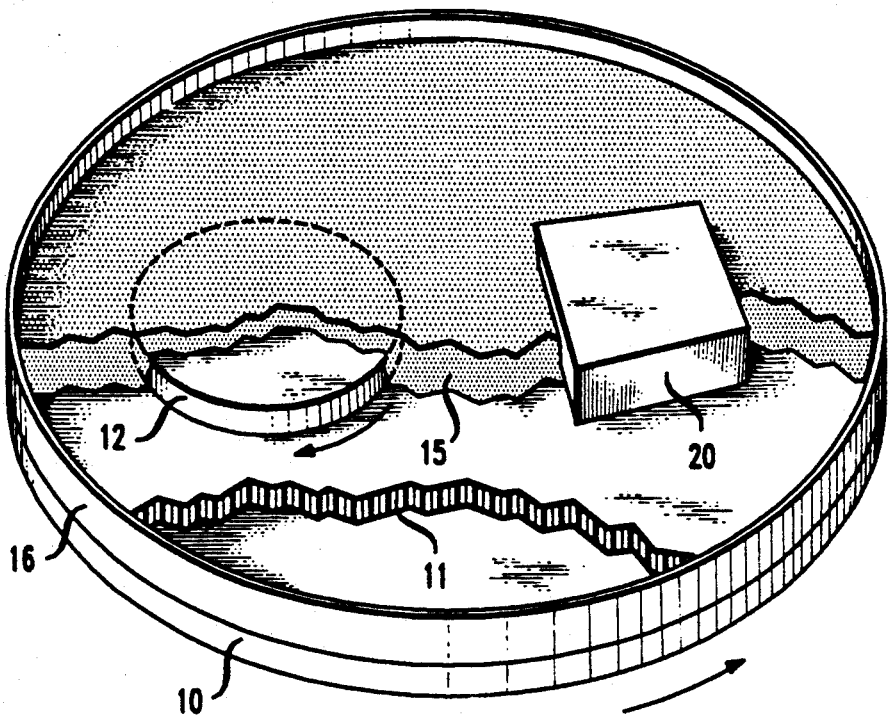
FIG. 1 is a schematic plan view of a slurry polisher constructed in accordance with the invention.

FIG. 1 is a schematic plan view showing the arrangement of platen 10 of a typical commercially-available slurry polisher used for polishing semiconductor wafers and showing the position of wafer 12 being polished and ultrasonic agitator 20 positioned in accordance with the invention. An example of such a slurry polisher without agitator 20 is the Model 372 made by Westech Systems Inc., 3502 E. Atlanta Ave., Phoenix, Az., 85040.

Figure 2:
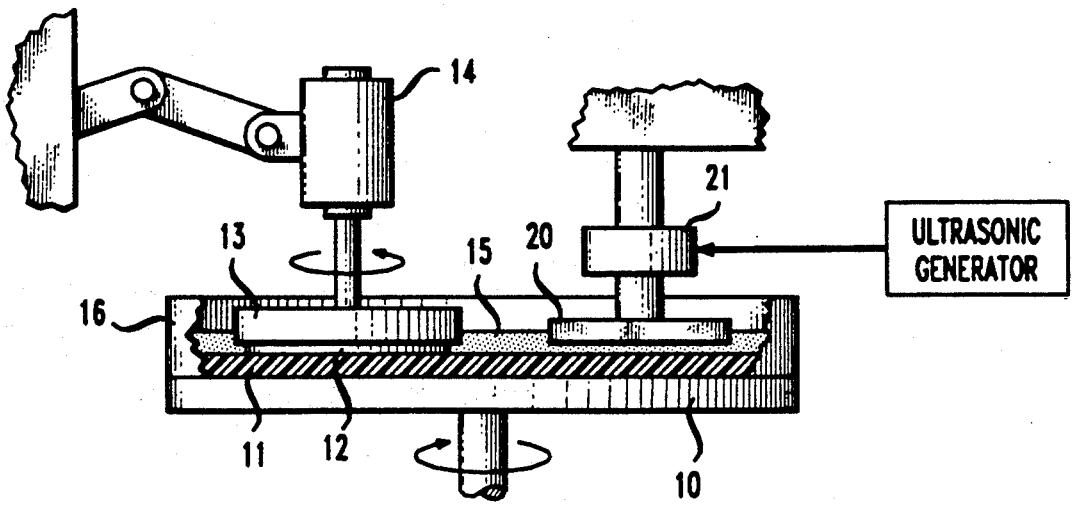
FIG. 2 is a partially cutaway side view of a slurry polisher showing the position of the ultrasonic apparatus used to agitate the slurry.

FIG. 2 is a partially cutaway side view of the same apparatus.

Referring to both FIGS. 1 and 2, platen 10 is mounted so that it can be rotated by a drive motor (not shown). Polishing pad 11 is mounted on the surface of platen 10 and rotates with it. These pads are typically 50 to 100 mils thick, spongy in nature and provided with a self-adhesive backing. Such pads are available from Rodel Inc., 451 Belleview Rd., Diamond State Industrial Park, Newark, Del. 19713 U.S.A. Semiconductor wafer 12 is held from above by holder 13, which presses wafer 12 against pad 11 with a pressure typically on the order of 3 to 10 lbs. per square inch. Holder 13 and wafer 12 are rotated by motor 14. In practice, motor 14 is usually mounted to apparatus that can move holder 13 to various locations to pick up wafers, clean wafers and drop off polished wafers at a point where they can proceed to the next process step.

A layer or "lake" of polishing slurry 15 covers pad 11, typically to a depth of about one half to one inch. One example of slurry 15 usable for polishing deposited layers on semiconductor wafers is a colloidal suspension of silica particles in a pH 8.3 to 8.7 solution of water and KOH. Such polishing slurries are available from Nalco Chemical Company, 6216 West 66th Place, Chicago, Ill. 60638 USA. Slurry 15 is kept in place by raised rim 16 on platen 10. If desired, slurry 15 can be continually replenished or recirculated from a separate reservoir (not shown).

Ultrasonic agitator 20 has its active surface immersed in slurry 15. Agitator 20 is typically attached to an ultrasonic transducer 21, which is fixed to the frame of the polisher. Transducer 21 can be a piezoelectric material such as Lead Zirconate Titanate (PZT), and is driven by an ultrasonic generator (not shown), typically operating at about 40 KHz. When ultrasonic energy is applied to the transducer, acoustic power is coupled into the liquid slurry solution throughout its volume in the vicinity of agitator 20. This energy extends, through the whole liquid layer under the agitator down to the polishing pad itself, where it tends to release accumulations of trapped grit on the pad and therefore render the pad interface more uniform. Furthermore, if the thickness of the liquid layer (between the bottom of agitator 20 and the surface of polishing pad 11) is intentionally arranged to be an integral number of quarter wavelengths thick, then the pad surface improvement action can be maximized. For a 40 kHz acoustic agitator this corresponds to a liquid layer that is approximately one half an inch thick.

In a typical application for planarizing, a layer of silicon dioxide is deposited on a semiconductor wafer, platen 10 and pad 11 are rotated at about 15 rpm and wafer 12 is rotated at about 40 rpm. Slurry 15 is typically heated to about 60 degrees C. Such planarizing operation usually takes from 5 to 8 minutes, and typically results in removal of about one micron of material from the surface of wafer 12.

The main beneficial effect of the ultrasonic agitation of slurry 15 is to dislodge grit and debris that becomes embedded in pad 11, thereby maintaining the uniformity of the pad and the polishing operation over a longer period of time. An additional beneficial effect is a corresponding improvement in the effective operating lifetime of the pad.

It is understood that other embodiments are possible that incorporate the principles of the invention and that the above disclosure is merely illustrative of such principles and is not intended to be limiting in any respect.

What is claimed is:

1. An improved method of polishing a planar workpiece comprising:

applying said workpiece to a rotating pad at a first location so that the motion of the pad with respect to the workpiece defines a circular path on said pad, said pad being covered with a polishing slurry; and agitating said slurry ultrasonically at a second location adjacent to said path but separated from said workpiece to dislodge embedded grit from said pad, thereby enhancing the polishing action of the slurry on said workpiece.

2. A method of planarizing a deposited layer on a semiconductor wafer comprising:

applying the deposited layer on said wafer to a rotating pad at a first location so that the motion of the pad with respect to the wafer defines a circular path on said pad, said pad being covered with a polishing slurry; and agitating said slurry ultrasonically at a second location adjacent to said path but separated from said wafer to dislodge embedded grit from said pad, thereby enhancing the polishing action of the slurry on said deposited layer.

3. The method of claim 1 or claim 2 wherein said agitating step further comprises:

immersing an ultrasonic agitator in said slurry to focus ultrasonic energy on said path at said second location; and applying ultrasonic energy to said agitator.

4. Improved apparatus for polishing a planar workpiece, which comprises:

a rotating horizontal pad carrying a quantity of polishing slurry;

means situated at a first location for applying said workpiece to said pad so that the motion of said pad with respect to said workpiece defines a circular path on said pad; and means situated at a second location adjacent to said path for ultrasonically agitating said slurry to dislodge embedded grit from said pad, thereby enhancing the polishing action of the slurry on said workpiece.

5. Improved apparatus for planarizing a deposited layer on a semiconductor wafer, which comprises:

a rotating horizontal pad carrying a quantity of polishing slurry;

means situated at a first location for applying the deposited layer on said wafer to said pad so that the motion of said pad with respect to said workpiece defines a circular path on said pad; and means situated at a second location adjacent to said path for ultrasonically agitating said slurry to dislodge embedded grit from said pad, thereby enhancing the polishing action of the slurry on said deposited layer.

6. The apparatus of claim 4 or claim 5 wherein said means for ultrasonically agitating further comprises:

an ultrasonic agitator coupled to an ultrasonic transducer driven by a source of ultrasonic energy, said agitator being immersed in said slurry and positioned to focus ultrasonic energy on said pad at said second location.

* * * * *